US006325030B1

(12) United States Patent
Spath et al.

(10) Patent No.: US 6,325,030 B1
(45) Date of Patent: Dec. 4, 2001

(54) ROLLER FINGER FOLLOWER FOR VALVE DEACTIVATION

(75) Inventors: Mark James Spath, Spencerport; Hermes A. Fernandez, Rochester, both of NY (US); Nick John Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/664,668

(22) Filed: Sep. 19, 2000

Related U.S. Application Data

(60) Provisional application No. 60/176,133, filed on Jan. 14, 2000.

(51) Int. Cl.[7] ..... F01L 13/00; F02D 13/06

(52) U.S. Cl. ..... 123/90.16; 123/90.42; 123/198 F

(58) Field of Search ..... 123/90.15, 90.16, 123/90.39, 90.41, 90.42, 90.43, 90.44, 198 F

(56) References Cited

U.S. PATENT DOCUMENTS 4,768,467 * 9/1988 Yamada et al. ..... 123/90.16
5,544,626 * 8/1996 Diggs et al. ..... 123/90.16
5,655,488 * 8/1997 Hampton et al. ..... 123/90.16
6,058,895 * 5/2000 Hermsen ..... 123/90.16
6,186,101 * 2/2001 Kreuter ..... 123/90.15

* cited by examiner

*Primary Examiner*—Weilun Lo
(74) *Attorney, Agent, or Firm*—John A. VanOphem

(57) ABSTRACT

A roller finger follower includes an elongate body having a first side and a second side. A first end and a second end interconnect and space apart the first and second sides. The first and second sides define a first and second pin orifice, respectively. A roller is disposed between the first and second sides intermediate the first and second ends of the body. The roller defines a shaft orifice therethrough. An elongate shaft extends transversely through the shaft orifice and has a first shaft end and a second shaft end. The first shaft end is disposed proximate the first side and the second shaft end is disposed proximate the second side. The first shaft end defines a pin chamber therein, the second shaft end defines a shaft bore therein. The shaft bore is concentric with and intersects the pin chamber. A locking pin assembly is disposed within each of the shaft bore, the pin chamber, and at least one of the pin orifices. The locking pin assembly has a default position wherein the shaft is coupled to the body, and a decoupled position wherein the shaft is decoupled from the body. The locking pin assembly is switchable between the default position and the decoupled position.

15 Claims, 3 Drawing Sheets

ROLLER FINGER FOLLOWER FOR VALVE DEACTIVATION

CROSS REFERENCE TO RELATED APPLICATIONS

This application claims the benefit of U.S. Provisional Patent Application Ser. No. 60/176,133, filed Jan. 14, 2000.

TECHNICAL FIELD

The present invention generally relates to cylinder and/or valve deactivation in internal combustion engines. More particularly, the present invention relates to a roller finger follower rocker arm device which accomplishes cylinder and/or valve deactivation in internal combustion engines.

BACKGROUND OF THE INVENTION

Automobile emissions are said to be the single greatest source of pollution in several cities across the country. Automobiles emit hydrocarbons, nitrogen oxides, carbon monoxide and carbon dioxide as a result of the combustion process. The Clean Air Act of 1970 and the 1990 Clean Air Act set national goals of clean and healthy air for all and established responsibilities for industry to reduce emissions from vehicles and other pollution sources. Standards set by the 1990 law limit automobile emissions to 0.25 grams per mile (gpm) nonmethane hydrocarbons and 0.4 gpm nitrogen oxides. The standards are predicted to be further reduced by half in the year 2004.

It is expected that automobiles will continue to be powered by internal combustion engines for decades to come. As the world population continues to grow, and standards of living continue to rise, there will be an even greater demand for automobiles. The increasing number of automobiles is likely to cause a proportionate increase in pollution. The major challenge facing automobile manufacturers is to further reduce undesirable and harmful emissions by improving fuel economy, thereby assuring the increased number of automobiles has a minimal impact on the environment. One method by which automobile manufacturers have attempted to improve fuel economy and reduce undesirable emissions is cylinder deactivation.

Generally, cylinder deactivation is the deactivation of the intake and/or exhaust valves of a cylinder or cylinders during at least a portion of the combustion process thereby reducing pumping work, and is a proven method by which fuel economy can be improved. In effect, cylinder deactivation reduces the number of engine cylinders within which the combustion process is taking place. With fewer cylinders performing combustion, fuel efficiency is increased. For example, in an eight-cylinder engine under certain operating conditions, four of the eight cylinders can be deactivated. Thus, combustion would be taking place in only four, rather than in all eight, cylinders. Cylinder deactivation is effective, for example, during part-load conditions when full engine power is not required for smooth and efficient engine operation. Studies have shown that cylinder deactivation can improve fuel economy by as much as fifteen percent.

Conventional methods of achieving cylinder deactivation, however, have generally been accomplished by the addition of numerous component parts to various portions of the valve train. These additional component parts, such as, for example, multiple springs, arm members, shaft members, and pins, have typically not fit within the space occupied by conventional drive train components. Thus, the conventional methods of implementing cylinder deactivation have required modification and redesign of valve trains and engines to provide the additional space within which to house the additional components used to achieve cylinder deactivation. Furthermore, conventional devices used to achieve cylinder deactivation are typically moderately complex mechanical devices assembled from numerous subassemblies and component parts. The assembly of a device from numerous component parts requires significant labor and the need to inventory and maintain a supply of the various component parts, thereby increasing the cost of manufacture. Moreover, the numerous component parts used in a conventional cylinder deactivation device contribute mass to the device, may impact the reliability of the device, and may limit the performance of the device to certain engine operating ranges.

Therefore, what is needed in the art is a cylinder deactivation device which is designed to fit within existing space occupied by conventional drive train components, thereby avoiding the need to redesign such engines and their valve trains.

Furthermore, what is needed in the art is a cylinder deactivation device that is relatively simple and uses a minimum of component parts, and is therefore manufactured in a cost-effective manner.

Yet further, what is needed in the art is a cylinder deactivation device having a low mass that is capable of operating over a substantial range of engine operating parameters.

SUMMARY OF THE INVENTION

The present invention provides a roller finger follower for use with an internal combustion engine.

The invention comprises, in one form thereof, an elongate body having a first side and a second side. A first end and a second end interconnect and space apart the first and second sides. The first and second sides define a first and second pin orifice, respectively. A roller is disposed between the first and second sides intermediate the first and second ends of the body. The roller defines a shaft orifice therethrough. An elongate shaft extends transversely through the shaft orifice and has a first shaft end and a second shaft end. The first shaft end is disposed proximate the first side and the second shaft end is disposed proximate the second side. The first shaft end defines a pin chamber therein, the second shaft end defines a shaft bore therein. The shaft bore is concentric with and intersects the pin chamber. A locking pin assembly is disposed within each of the shaft bore, the pin chamber and at least one of the pin orifices. The locking pin assembly has a default position wherein the shaft is coupled to the body, and a decoupled position wherein the shaft is decoupled from the body. The locking pin assembly is switchable between the default position and the decoupled position.

An advantage of the present invention is that the roller finger follower enables cylinder and/or valve deactivation while occupying the same space within an internal combustion engine as occupied by a conventional roller finger follower.

Another advantage of the present invention is that very few component parts are added relative to a conventional roller finger follower, thereby increasing reliability, decreasing mass, and decreasing volume required to house the roller finger follower.

Yet another advantage of the present invention is that the roller finger follower can be easily and cost-effectively manufactured and assembled.

A still further advantage of the present invention is that the roller finger follower is capable of operating over a substantial range of engine operating parameters.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Generally, and as will be described more particularly hereinafter, the roller finger follower of the present invention has a default and a decoupled state. The roller finger follower of the present invention is switchable between the default state and the decoupled state. In the default state, the roller finger follower transfers rotary motion of a cam lobe of an internal combustion engine to pivotal movement of the body of the roller finger follower to thereby actuate a valve stem of the engine which, in turn, opens and closes a corresponding engine valve. In the decoupled state, rotary motion of the cam is absorbed by the roller finger follower. Thus, the valve stem is not actuated and the valve of the engine is not opened or closed, thereby deactivating the corresponding cylinder.

Figure 1:
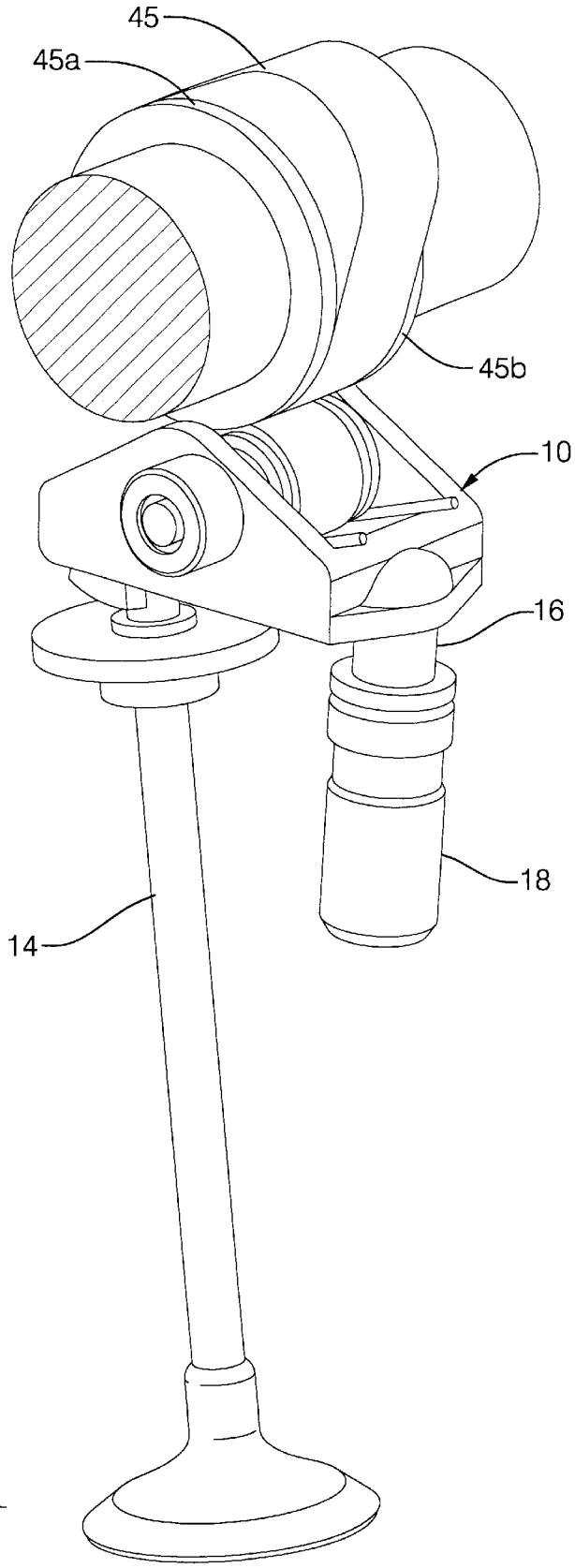
FIG. 1 is a perspective view of one embodiment of the roller finger follower of the present invention as installed in an internal combustion engine.
Figure 2:
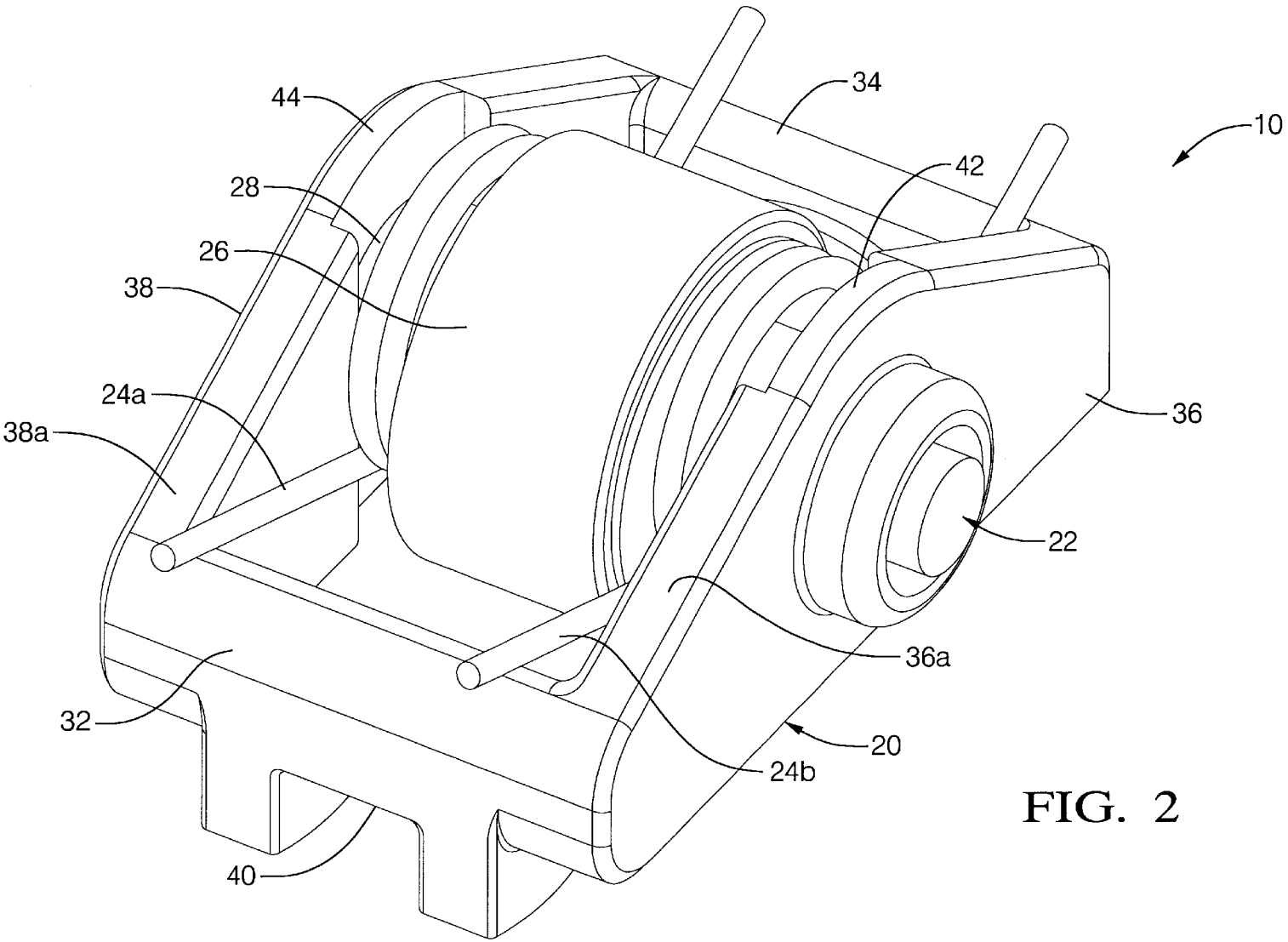
FIG. 2 is a perspective view of the roller finger follower of FIG. 1.

Referring now to the drawings and particularly to FIG. 1, there is shown one embodiment of a roller finger follower 10 of the present invention. Roller finger follower (RFF) 10 is installed in internal combustion engine 12. One end of RFF 10 engages valve stem 14 of engine 12, the other end engages a stem 16 of lash adjuster 18. Referring now to FIG. 2, RFF 10 includes body 20, locking pin assembly 22, lost motion springs 24*a* and 24*b*,roller 26, and hollow shaft 28.

Body 20 includes first end 32, second end 34, elongate first side member 36, and elongate second side member 38. First end 32 includes valve stem seat 40, which receives valve stem 14 of engine 12. Second end 34 defines a semi-spherical lash adjuster socket 41 (see FIG. 3), which receives lash adjuster stem 16 of engine 12. Each of first side member 36 and second side member 38 are somewhat arch-like or parabolic in shape, and extend longitudinally between first end 32 and second end 34. Each of first side member 36 and second side member 38 include a respective top surface 36*a* and 38*a*. Each top surface 36*a*, 38*a* defines a somewhat rounded slider pad or portion 42, 44, respectively, disposed approximately midway between first end 32 and second end 34. Slider pads 42, 44 engage zero or low lift lobes 45*a*, 45*b* (FIG. 1) of the camshaft of engine 12. Cam lobe 45 is disposed between the zero or low lift cam lobes 45*a*, 45*b*.

Figure 3:
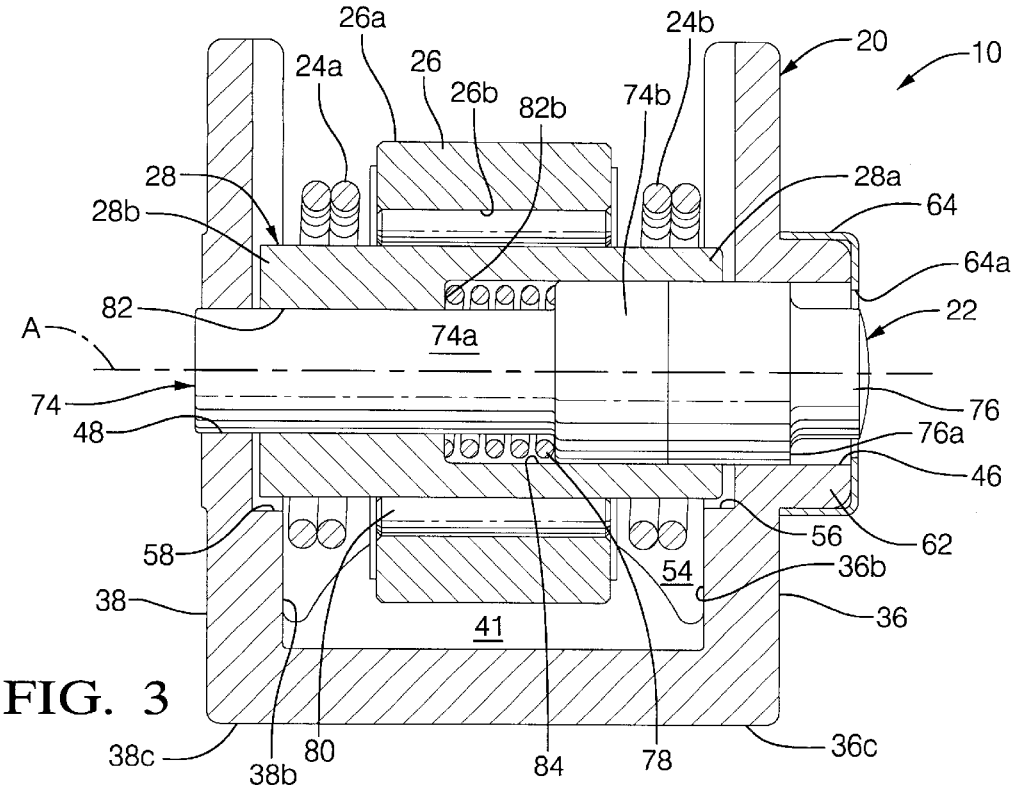
FIG. 3 is a cross-sectional view of the locking pin assembly of FIG. 1 in the default position.

As best shown in FIG. 3, each of first side member 36 and second side member 38 define a respective pin orifice 46, 48 therethrough. Each of pin orifices 46, 48, is concentric with center axis A. First side member 36 and second side member 38 each include an inside surface 36*b*, 38*b*, respectively. Roller aperture 54 is defined between inside surfaces 36*b*, 38*b*, and intermediate first end 32 and second end 34. Inside surface 36*b* defines groove 56, which is disposed adjacent roller aperture 54. Inside surface 36*b* defines groove 58, which is disposed adjacent roller aperture 54 transversely opposite groove 56. Each of grooves 56, 58 extend from a respective top surface 36*a*, 38*a* to a respective bottom surface 36*c*, 38*c* of first and second side members 36, 38. First side member 36 further defines boss 62. Boss 62 surrounds pin orifice 46 in first side member 36. Retaining clip 64 is secured, such as, for example, by rolling, to boss 62. Retaining clip 64 defines a retaining clip orifice 64*a* which is substantially concentric with pin orifice 46. Body 20 is constructed of, for example, steel, carbon steel, or alloy steel.

Locking pin assembly 22, as best shown in FIG. 3 includes locking pin 74, button 76, and pin spring 78. Locking pin 74 includes stem portion 74*a* and head 74*b*. Locking pin 74 is slidably disposed at least partially within shaft 28, as will be described more particularly hereinafter. Button 76 is a substantially cylindrical member having shoulder 76*a*. Button 76 is slidably disposed at least partially within pin orifice 46 in first side member 36 and is selectively received within shaft 28, as will also be described more particularly hereinafter. Pin spring 78 is disposed within shaft 28 in association with locking pin 74, and biases locking pin assembly into the decoupled or deactivated state or position. Each of locking pin 74 and button 76 are constructed of, for example, steel, carbon steel, or alloy steel. Pin spring 78 is constructed of, for example, chrome silicon and configured as, for example, a coil spring.

Lost motion springs 24*a* and 24*b* (FIG. 2) are coiled around opposite ends of shaft 28. More particularly, lost motion spring 24*a* is coiled around the end of shaft 28 that is proximate second side member 38 and lost motion spring 24*b* is coiled around the end of shaft 28 that is proximate first side member 36. Each of lost motion springs 24*a* and 24*b* extend radially from shaft 28 to abuttingly engage each of first end 32 and second end 34 of body 12. Each of lost motion springs 24*a* and 24*b* apply a spring force or load upon hollow shaft 28 to thereby bias hollow shaft 28 in the direction of slider pads 44, 42, respectively. Lost motion springs 24*a* and 24*b* are configured as, for example, a coil spring, and is constructed of, for example, chrome silicon.

Roller 26 is a substantially cylindrical hollow member which includes outside surface 26*a* and central bore or orifice 26*b*. Elongate hollow shaft 28 extends through central orifice 26*b* to thereby couple roller 26 to each of first side member 36 and second side member 38, and thus to body 20. A plurality of needle bearings 80 are disposed intermediate central orifice 26*b* of roller 26 and hollow shaft 28. Thus, roller 26 is free to rotate about hollow shaft 28 in an essentially friction free manner. Outside surface 26*a* of roller 26 is configured to engage cam lobe 45 (FIG. 1) of internal combustion engine 12. Roller 26 is constructed of, for example, steel, carbon steel, or alloy steel.

Shaft 28 is an elongate substantially cylindrical hollow member extending transversely between first side member 36 and second side member 38. Shaft 28 has first end 28*a* disposed in groove 56 and second end 26*b* disposed within groove 58. Shaft 28 has a diameter of a predetermined size to enable it to freely reciprocate within each of grooves 56, 58 in a vertical direction while preventing any binding or movement of shaft 28 toward or away from either of first end 32 and second end 34. Shaft 28 defines shaft bore 82 and pin chamber 84. Each of shaft bore 82 and pin chamber 84 are substantially concentric relative to central axis A. Shaft bore 82 and pin chamber 84 are contiguous with and intersect each other at shoulder 82*b*. Stem portion 74*a* of locking pin 74 is slidably disposed at least partially within shaft bore 82 and pin chamber 84, and is selectively received within pin orifice 48. Pin spring 78 is disposed in abutting engagement with each of head 74*b* of locking pin 74 and shoulder 82*b* of shaft bore 82. Pin spring 78 pre-loads or biases locking pin assembly 22 toward the decoupled position. Button 76 is slidingly disposed at least partially within first pin orifice 46 and is selectively received within pin chamber 84. Shaft 28 is constructed of, for example, steel, carbon steel, or alloy steel.

In the normal or default position, as shown in FIG. 3, locking pin assembly 22 couples shaft 28 to body 20 to thereby transfer rotary motion of cam lobe 45 (FIG. 1) to vertical motion of valve stem 14 (FIG. 1). In the default position, stem portion 74*a* of locking pin 74 is disposed within each of pin orifice 48 in second side member 38, shaft bore 82 and pin chamber 84, thereby coupling shaft 28 to second side member 38 in the default position. Button 76, in the default position, is disposed within each of pin chamber 84 and pin orifice 46 of first side member 36. Thus, button 76 couples shaft 28 to first side member 36. With locking pin assembly 22 in the default position, as described above, shaft 28 is coupled to each of first side member 36 and second side member 38. Rotary motion of cam lobe 45 is transferred by roller 26 to shaft 28. The coupling of shaft 28 to each of first and second side members 36, 38, respectively, by locking pin assembly 22 transfers the rotary motion of cam lobe 45 via roller 26 and shaft 28 to pivoting movement of body 20 about lash adjuster 18, thereby reciprocating valve stem 14 and actuating a corresponding valve of engine 12.

Figure 4:
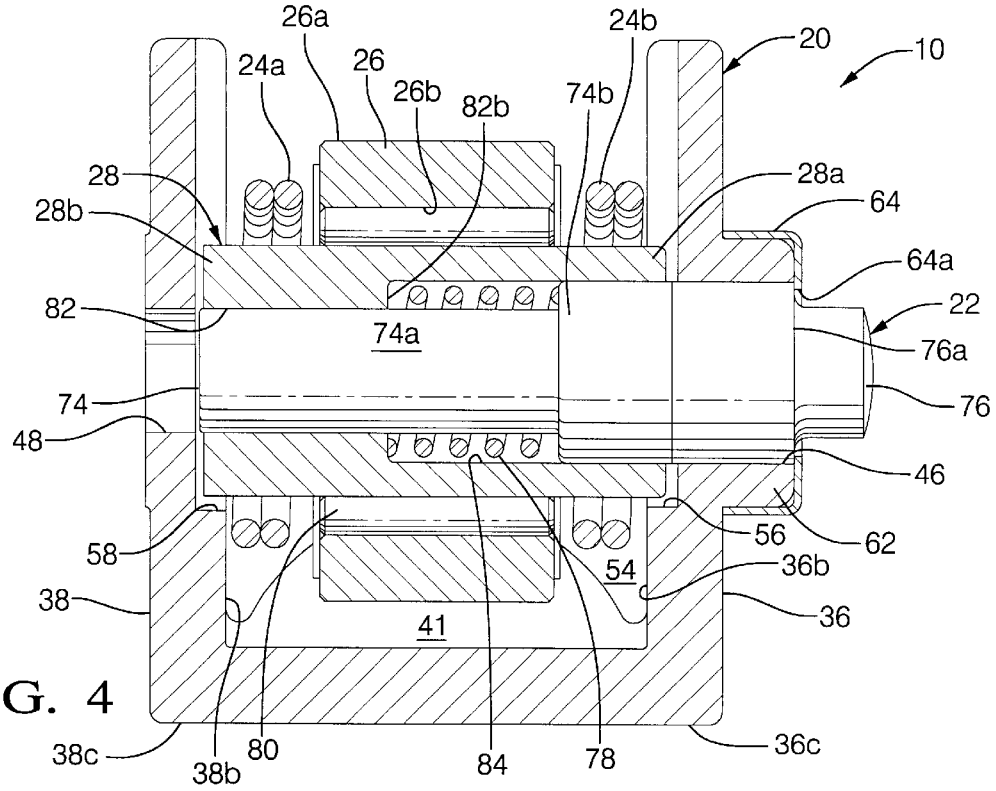
FIG. 4 is a cross-sectional view of the locking pin assembly of FIG. 1, in the decoupled position.

Locking pin assembly 22 is now described in the decoupled mode as shown in and with reference to FIG. 4. In the decoupled mode, button 76 is disposed only within pin orifice 46 of first side member 36. A portion of button 76 extends from pin orifice 46 on the side of first side member 36 that is opposite inside surface 36*b* thereof. Similarly, locking pin 74 is disposed only within shaft bore 82 and pin chamber 84 of shaft 28. In contrast to the default position, no portion of locking pin 74 is disposed within pin orifice 48 and no portion of button 76 is disposed within pin chamber 84 when locking pin assembly 22 is in the decoupled mode. Thus, shaft 28 is not coupled to either of first side member 36 or second side member 38 of body 20. Therefore, as rotary motion of cam lobe 45 is transferred by roller 26 to shaft 28, shaft 28 is correspondingly displaced relative to body 20. More particularly, rotary motion of cam lobe 45 is transferred via roller 26 to reciprocation of shaft 28 within each of grooves 56 and 58 in a direction toward and away from slider pads 42 and 44. In contrast to the default position, rotary motion of cam lobe 45 is not transferred by shaft 28 to pivotal movement of body 20, and therefore valve stem 14 is not reciprocated nor is a corresponding valve of engine 12 actuated.

In use, RFF 10 is disposed such that outer surface 26*a* of roller 26 engages cam lobe 45, valve stem seat 40 receives valve stem 14, and lash adjuster socket 41 engages lash adjuster stem 16. With locking pin assembly 22 in the decoupled mode, slider pads 42, 44 engage zero or low lift lobes 45*a*, 45*b* of the camshaft of engine 12 to thereby prevent any undesirable pump up of lash adjuster 18 due to oil pressure. Locking pin assembly 22 is selectively placed into the decoupled and default states by a control device (not shown), such as, for example, a hydraulic actuating piston (not shown) which is mounted into a bore on the cam bearing tower (not shown) adjacent RFF 10. The actuating piston is in axial alignment with button 76 of locking pin assembly 22. Pressurized fluid, such as, for example, oil, is selectively fed into and removed from the bore of the actuating piston to thereby cause the actuating piston to translate outward or retract inward in a direction toward and away from button 76.

Locking pin assembly 22 is placed into the default state, wherein shaft 28 is coupled to body 20, by translating the actuating piston outward and into engagement with button 76. The actuating piston overcomes the force of pin spring 78 and slidingly displaces button 76 axially in a direction toward second side member 38. The actuating piston displaces at least a portion of button 76 from within pin orifice 46 and into pin chamber 84 of shaft 28. The displacement of button 76 into pin chamber 84 results in a corresponding displacement of stem portion 74*a* of locking pin 74 out of shaft bore 82 and into pin orifice 48 of second side member 38. Thus, shaft 28 is coupled to each of first side member 36 and second side member 38. The actuating piston axially displaces button 76 into pin orifice 46 a predetermined distance in a direction toward second side member 38.

Locking pin assembly 22 is placed into the decoupled state by retracting the actuating piston inward thereby disengaging the actuating piston from contact with button 76. As stated above, pin spring 78 is disposed, or compressed, between shoulder 82*b* of shaft bore 82 and head 74*b* of locking pin 74. Pin spring 78 exerts an axially directed force against head 74*b* to thereby pre-load or normally bias locking pin assembly 22 into the decoupled or deactivated position. Pin spring 78 slidingly displaces locking pin 74 axially in the direction of first side member 36 and into abutting engagement with button 76. The displacement of locking pin 74 results in a corresponding displacement of button 76 in the same direction. Button 76 is thus displaced until shoulder 76*a* of button 76 contacts retaining clip 64. The engagement of shoulder 76*a* by retaining clip 64 limits the axial displacement of button 76 by pin spring 78, and thereby establishes the decoupled mode positions of locking pin 74 and button 76 relative to body 20.

In the decoupled mode, the interface of locking pin 74 and button 76 is disposed within groove 56 of first side member 36. This axial position permits locking pin 74 to move relative to or slide over button 76 within groove 56 in a direction toward and away from bottom surface 36c of first side members 36. Similarly, in the decoupled state, the end of locking pin 74 proximate second side member 38*c* is disposed within groove 58 of second side member 38. This axial position permits locking pin 74 to move or slide within groove 48 in a direction toward and away from bottom surface 38*c* of second side member 38. Thus, shaft 28 is likewise enabled to move or slide within each of grooves 56, 58 in a direction toward and away from each of bottom surfaces 36*c*, 38*c* of first and second side members 36, 38, respectively.

In the decoupled state, lost motion springs 24*a* and 24*b* absorb the motion of shaft 28 and ensure that roller 26 remains in contact with cam lobe 45.

Grooves 56, 58 retain and guide the movement of shaft 28 as cam lobe 45 rotates and displaces shaft 28. As stated above, lost motion springs 24*a* and 24*b* are coiled around respective ends of shaft 28 proximate to second side member 38 and first side member 36, respectively. Each of lost motion springs 24*a* and 24*b* extend radially from shaft 28 to abuttingly engage each of first end 32 and second end 34 of body 12. Lost motion springs 24*a* and 24*b* apply a spring force or load upon shaft 28 to thereby bias shaft 28 in the direction of slider pads 44, 42, respectively. As cam lobe 45 is rotated from a low lift to a higher lift profile, a downward force is exerted upon shaft 28. The force of lost motion springs 24*a* and 24*b* upon shaft 28 is overcome by the force exerted by cam lobe 45 through roller 26 upon shaft 28, thereby resulting in shaft 28 being slidingly displaced downward within grooves 56, 58 in a direction toward bottom surfaces 36*c*, 38*c* of first and second body members 36, 38, respectively. The downward motion of shaft 28 is absorbed by lost motion springs 24*a* and 24*b*.

As cam lobe 45 is rotated from a higher lift position to a lower lift position, the load exerted upon shaft 28 by lost motion springs 24*a* and 24*b* maintains roller 26 in contact with cam lobe 45. As cam lobe 45 returns to its zero lift profile, lost motion springs 24*a*, 24*b* bias shaft 28 upward within grooves 56, 58 in the direction of slider pads 42, 44 and into a position which enables the return of locking pin assembly 22 into the default position.

It should be particularly noted that registration of pin orifices 46 and 48 relative to shaft bore 82 and pin chamber 84 is conjunctively accomplished by roller 26, cam lobe 45 and lost motion springs 24*a*, 24*b*. When cam lobe 45 is at its zero or lowest lift profile position, lost motion springs 24*a* and 24*b* bias shaft 28 toward slider pads 42 and 44, and keep outer surface 26*a* of roller 26 engaged with cam lobe 45. The diameter of roller 26 is selected such that shaft bore 82 and pin chamber 84 are axially aligned with pin orifices 46 and 48 when cam lobe 45 is at its zero lift or lowest lift position. The axial alignment of shaft bore 82 and pin chamber 84 with pin orifices 46, 48 which, in turn, brings stem portion 74*a* of locking pin 74 into axial alignment with pin orifice 48 and head 74*b* into axial alignment with pin orifice 46 having button 76 disposed therein. Pin spring 78 then displaces locking pin 74 in a direction toward first side member 36. Pin spring 78 continues to displace locking pin 74 in a direction toward first side member 36*c* such that head 74*b* of locking pin 74 engages and displaces button 76. Thus, button 76 is displaced from disposition within pin chamber 84. The displacement of locking pin 74 and button 76 continues until shoulder 76*a* of locking pin 76 engages retaining clip 64.

In the embodiment shown, retaining clip 64 is disclosed as being secured, such as, for example, by rolling, to boss 62. However, it is to be understood that RFF 10 may be alternately configured, such as, for example, as having a retaining clip formed integrally with the boss or body or attached by alternate means, such as, for example, staking or welding.

In the embodiment shown, each of grooves 56 and 58 extend from bottom surface 36*c*, 38*c*, respectively, to a top surface 36*a*, 38*a*, respectively. However, it is to be understood that the grooves may be alternately configured, such as, for example, extending only partially toward one or both of the top and bottom surfaces of the roller finger follower body.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A roller finger follower for use with an internal combustion engine, said roller finger follower comprising:

an elongate body having a first side member and a second side member, a first end and a second end interconnecting and spacing apart said first and second side member, said first and second side member defining a first and second pin orifice, respectively;

a roller disposed between said first and second side member intermediate said first end and said second end of said body, said roller defining a shaft orifice therethrough;

an elongate shaft extending transversely through said shaft orifice, said shaft having a first shaft end and a second shaft end, said first shaft end being disposed proximate said first side member, said second shaft end being disposed proximate said second side member, said second shaft end defining a shaft bore therein, said first shaft end defining a pin chamber therein, said shaft bore being substantially concentric with and intersecting said pin chamber, said shaft bore having a different diameter than said pin chamber; and a locking pin assembly disposed partially within each of said shaft bore, said pin chamber and at least one of said pin orifices, said locking pin assembly having a default position wherein said shaft is coupled to said body and a decoupled position wherein said shaft is decoupled from said body, said locking pin assembly being switchable between said default position and said decoupled position.

2. The roller finger follower of claim 1, wherein said locking pin assembly comprises:

an elongate locking pin having a stem portion, said locking pin slidably disposed at least partially within said shaft bore and said pin chamber, said stem portion of said locking pin being disposed within each of said shaft bore and said second pin orifice when said locking pin assembly is in said default position, said stem portion of said locking pin being disposed substantially entirely within said shaft bore when said locking pin assembly is in said decoupled position.

3. The roller finger follower of claim 2, wherein said locking pin assembly further comprises a button, said button slidably disposed at least partially within said first pin orifice, said button being disposed partially within said first pin orifice and partially within said pin chamber when said locking pin assembly is in said default position, said button being disposed substantially entirely within said first pin orifice when said locking pin assembly is in said decoupled position.

4. The roller finger follower of claim 3, wherein said locking pin assembly further comprises a pin spring, said pin spring configured for biasing said locking pin assembly into said decoupled position.

5. The roller finger follower of claim 4, further comprising a shoulder defined at the intersection of said pin chamber and said shaft bore, said locking pin including a head portion disposed within said pin chamber, said pin spring being compressed intermediate said shoulder and said head portion of said locking pin.

6. The roller finger follower of claim 1, further comprising a boss being one of formed integrally with and attached to said first side member, said boss surrounding said first pin orifice, a retainer clip being one of formed integrally with and attached to said boss, said retainer clip defining a retainer orifice, said retainer orifice being substantially concentric relative to said first pin orifice, said retainer clip configured for limiting sliding movement of said button within said first pin orifice in a direction away from said second side member.

7. The roller finger follower of claim 6, wherein said button includes a shoulder, said shoulder in abutting engagement with said retainer clip when said locking pin assembly is in said decoupled position.

8. The roller finger follower of claim 1, further comprising at least one lost motion spring, said at least one lost motion spring extending between said shaft and at least one of said first end and said second end of said body.

9. The roller finger follower of claim 8, wherein each of said at least one lost motion spring is coiled around a respective portion of said shaft proximate a corresponding one of said first and said second side members, said at least one lost motion spring extending therefrom to engage each of said first end and said second end of said body.

10. The roller finger follower of claim 1, wherein said first side member defines a first groove, said second side member defines a second groove, each of said first and said second grooves extending from a bottom surface of a corresponding one of said first and said second side members to a top surface thereof, each of said first pin orifice and said second pin orifice being disposed within a corresponding one of said first and said second groove, said first shaft end being disposed within said first groove and said second shaft end being disposed within said second groove.

11. The roller finger follower of claim 1, wherein said first side member defines a first slider pad and said second side member defines a second slider pad, each of said first and said second slider pad configured for engaging a respective zero lift cam lobe of the internal combustion engine.

12. An internal combustion engine, comprising:

a roller finger follower, said roller finger follower including:

an elongate body having a first side member and a second side member, a first end and a second end interconnecting and spacing apart said first and second side member, said first and second side member defining a first and second pin orifice, respectively;

a roller disposed between said first and second side member intermediate said first end and said second end of said body, said roller defining a shaft orifice therethrough;

an elongate shaft extending transversely through said shaft orifice, said shaft having a first shaft end and a second shaft end, said first shaft end being disposed proximate said first side member, said second shaft end being disposed proximate said second side member, said second shaft end defining a shaft bore therein, said first shaft end defining a pin chamber therein, said shaft bore being substantially concentric with and intersecting said pin chamber, said shaft bore having a different diameter than said pin chamber; and a locking pin assembly disposed partially within each of said shaft bore, said pin chamber, and at least one of said pin orifices, said locking pin assembly having a default position wherein said shaft is coupled to said body and a decoupled position wherein said shaft is decoupled from said body, said locking pin assembly being switchable between said default position and said decoupled position.

13. The internal combustion engine of claim 12, wherein said locking pin assembly comprises:

an elongate locking pin having a stem portion, said locking pin slidably disposed at least partially within said shaft bore and said pin chamber, said stem portion of said locking pin being disposed within each of said shaft bore and said second pin orifice when said locking pin assembly is in said default position, said stem portion of said locking pin being disposed substantially entirely within said shaft bore when said locking pin assembly is in said decoupled position;

a button, said button slidably disposed at least partially within said first pin orifice, said button being disposed partially within said first pin orifice and partially within said pin chamber when said locking pin assembly is in said default position, said button being disposed substantially entirely within said first pin orifice when said locking pin assembly is in said decoupled position; and a pin spring, said pin spring configured for biasing said locking pin assembly into said decoupled position.

14. The internal combustion engine of claim 12, wherein said roller finger follower further comprises at least one lost motion spring, said at least one lost motion spring extending between said shaft and at least one of said first end and said second end of said body of said roller finger follower.

15. The internal combustion engine of claim 12, wherein said first side member of said roller finger follower defines a first groove, said second side member defines a second groove, each of said first and said second grooves extending from a bottom surface of a corresponding one of said first and said second side members to a top surface thereof, each of said first pin orifice and said second pin orifice being disposed within a corresponding one of said first and said second groove, said first shaft end being disposed within said first groove and said second shaft end being disposed within second groove.

* * * * *